United States Patent [19]

Weining et al.

[11] Patent Number: 4,563,998

[45] Date of Patent: Jan. 14, 1986

[54] CONTROL ARRANGEMENT FOR AN INTERNAL COMBUSTION ENGINE

[75] Inventors: Hans-Karl Weining, Esslingen; Juergen Kienle, Stuttgart; Wilfried Christl, Winterbach, all of Fed. Rep. of Germany

[73] Assignee: Daimler-Benz Aktiengesellschaft, Fed. Rep. of Germany

[21] Appl. No.: 587,700

[22] Filed: Mar. 8, 1984

[30] Foreign Application Priority Data

Mar. 9, 1983 [DE] Fed. Rep. of Germany ..... 3308261

[51] Int. Cl.[4] ..... F02M 25/06

[52] U.S. Cl. ..... 123/568

[58] Field of Search ..... 123/568, 571, 587; 137/854, 512.1, 599.1, DIG. 8

[56] References Cited

U.S. PATENT DOCUMENTS

| | | | |
|---|---|---|---|
| 3,783,847 | 1/1974 | Kolody | 123/568 |
| 4,150,648 | 4/1979 | Ogita | 123/568 |
| 4,187,811 | 2/1980 | Katoh et al. | 123/568 |
| 4,359,034 | 11/1982 | Mase et al. | 123/568 X |
| 4,393,840 | 7/1983 | Tanaka et al. | 123/568 X |

FOREIGN PATENT DOCUMENTS

| | | |
|---|---|---|
| 2550826 | 9/1976 | Fed. Rep. of Germany . |
| 2822337 | 4/1982 | Fed. Rep. of Germany . |

*Primary Examiner*—Craig R. Feinberg
*Assistant Examiner*—W. R. Wolfe
*Attorney, Agent, or Firm*—Barnes & Thornburg

[57] ABSTRACT

A control arrangement for an internal combustion engine equipped with vacuum-operated control devices includes a method and apparatus for applying a vacuum to a control device, retaining the vacuum for a specified time or under specified engine operating conditions and then reducing the vacuum in a controlled manner. A particular arrangement used to control an exhaust gas return system includes a no-return valve, connected in the vacuum line leading to an exhaust gas return valve, and a by-pass valve for by-passing the non-return valve under specified conditions. Exhaust gas return is maintained over a range of engine operating conditions, incurring a full load condition, to reduce $NO_x$ emissions to desired levels.

20 Claims, 7 Drawing Figures

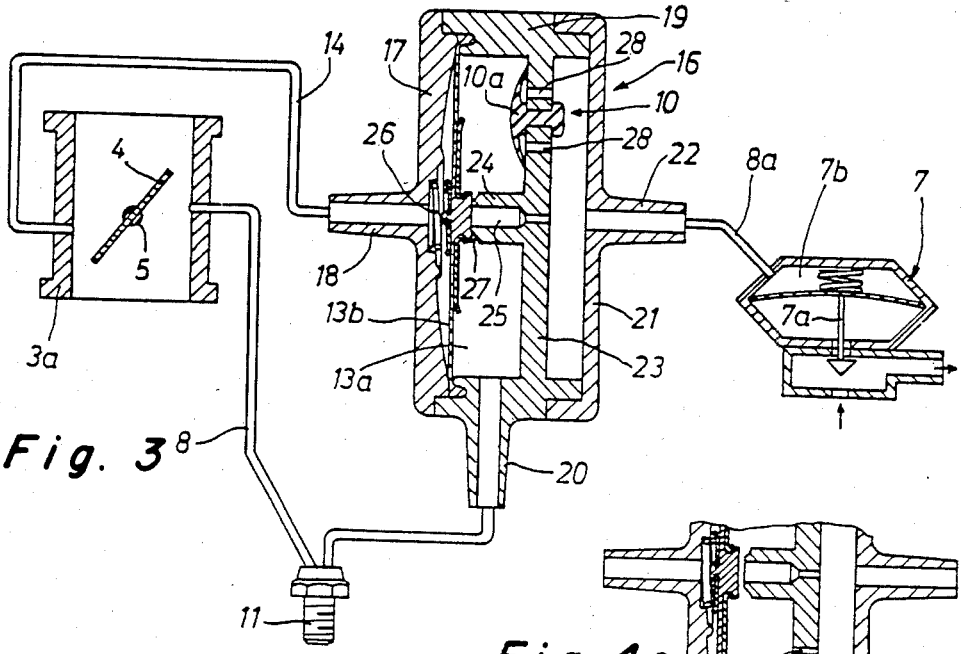
Fig. 3
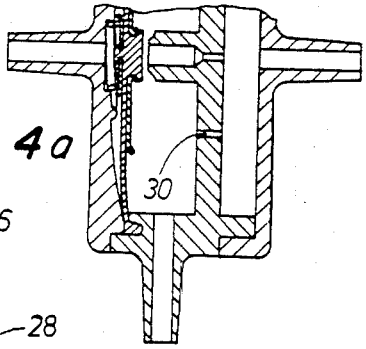
Fig. 4a
Fig. 4
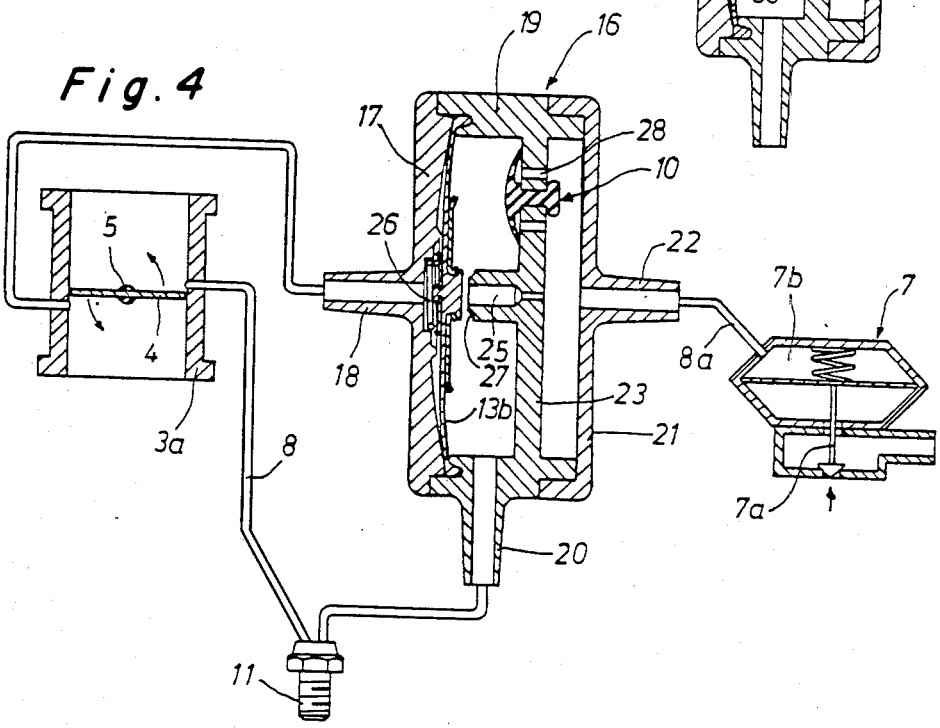

CONTROL ARRANGEMENT FOR AN INTERNAL COMBUSTION ENGINE

BACKGROUND AND SUMMARY OF THE INVENTION

This invention relates to a control arrangement for an internal combustion engine equipped with vacuum operated control devices. More specifically, this invention relates to a control apparatus for applying a vacuum to a control device, locking or retaining the vacuum applied for a specified time or under specified conditions, and then reducing the vacuum in a controlled manner. A preferred embodiment of the invention is well-suited for application to an exhaust gas return (EGR) system of the type which has a diaphragm-operated EGR valve in the EGR tube which connects the exhaust pipe to the air induction pipe.

An exhaust gas return system is known from German Pat. No. 2,822,337. In that system, in order to obtain an effective reduction of the $NO_x$, the ratio of the total volume of the returned exhaust gas to the volume of the induced air is kept constant independent of the loading on the internal combustion engine by means which, in the exhaust gas return system, control not only internally returned amounts of exhaust gas but also externally returned amounts. A valve, operating in response to the engine vacuum, determines the quantities of atmospheric air returned externally into the by-pass which can be closed by a by-pass valve whose operation is dependent on the exhaust gas pressure existing at any time.

In contrast to the exhaust gas return system described above (which corresponds to an exhaust gas back pressure controlled system) an object of the present invention is to produce a simplified low cost control apparatus for an exhaust gas return system which effectively reduces $NO_x$ emissions.

This objective is attained, in accordance with the present invention, by providing apparatus in the EGR system for locking or retaining the vacuum applied to the EGR value under certain conditions, followed by a reduction of the vacuum in a specified manner.

Particularly in the case of small engines in heavy vehicles, the engine is often operated in or near full load during prescribed emission tests. Since it is precisely in this range that the largest $NO_x$ emissions occur, maintenance of the exhaust gas return in this range is desirable. This occurs, in an arrangement according to the present invention, in a simple manner by locking in the vacuum in the section of the vacuum control tube leading to the exhaust gas return valve. By keeping the exhaust gas return valve open, adequate amounts of exhaust gas return are provided in the upper part of the load range of the engine to reduce $NO_x$ emission to the necessary extent without adversely affecting vehicle driving properties or fuel consumption.

More specifically, an advantageous embodiment of an EGR system which includes apparatus according to the present invention comprises an exhaust pipe, an air induction pipe (induction pipe), a regulating device such as a butterfly valve arranged as a throttle in the induction pipe, a vacuum-operated exhaust gas return valve connected to a vacuum source by a vacuum control tube, a non-return valve located in the vacuum control tube for retaining a vacuum supplied to the EGR valve throughout a range of engine load conditions, and a by-pass valve for relieving the trapped vacuum in a controlled manner. In the preferred embodiment described below, the vacuum control tube is connected to the air induction pipe at a point which is located upstream (on the ambient air pressure side) of the throttle butterfly when the throttle butterfly is closed, but which is located downstream (on the vacuum side) of the throttle butterfly when the throttle butterfly is open. Also, in the preferred embodiment described below, the by-pass valve is a diaphragm-operated device controlled by a pressure tube connected to the air induction pipe at a point which is located downstream of the throttle butterfly when the throttle butterfly is closed, but which is located upstream of the throttle butterfly when the throttle butterfly is open.

An especially preferred compact embodiment of the invention has the non-return valve and the bypass valve constructed in a single multi-part housing. The compact embodiment which includes this single control valve housing has an advantage, when compared with the embodiment comprising individual parts, in that the diaphragm of the by-pass valve can be subjected to differential pressure and a high degree of switching accuracy can be obtained independent of varying absolute pressures (caused, for example, by air filter resistances).

By the addition of a compression spring acting on the diaphragm of the by-pass valve, the exhaust gas return can be interrupted, with proper spring selection, before the engine is fully loaded. By this measure, the thermal loading on the engine can be reduced under full load operating conditions and the performance improved by increasing the supply of fresh air to the cylinders.

Instead of a compression spring, the control valve housing can have a duct (i.e., an orifice), which acts as a throttle, in an intermediate wall of the housing which also contains the non-return valve. The duct makes possible a time dependent opening of the exhaust gas return valve so that the exhaust gas return is maintained only as long as is desirable.

Further objects, features, and advantages of the present invention will become more apparent from the following description when taken with the accompanying drawings which show, for purposes of illustration only, several embodiments in accordance with the present invention.

BRIEF DESCRIPTION OF THE DRAWINGS

FIG. 3 shows the position of each of the by-pass and non-return valves for an approximately half-open throttle butterfly;

FIG. 4 shows the position of each of the by-pass and non-return valves for a closed throttle butterfly;

FIG. 4*a* shows an enlarged view of the control valve housing with a by-pass duct;

DETAILED DESCRIPTION OF THE DRAWINGS

Figure 1:
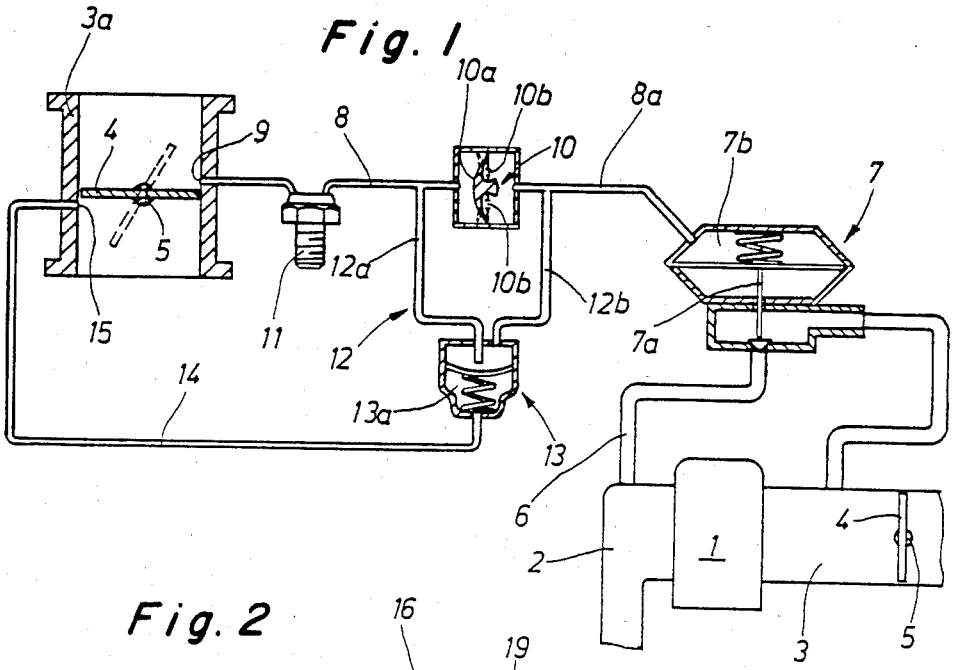
FIG. 1 shows an exhaust gas return system comprising individual parts.

Referring to FIG. 1, an internal combustion engine is indicated by 1, an exhaust pipe by 2 and an air induction pipe by 3. A throttle butterfly 4 with a throttle butterfly shaft 5 is provided in induction pipe 3. The section of induction pipe 3 containing throttle butterfly 4 is stub pipe 3*a* which is shown enlarged on the left hand side of FIG. 1. Exhaust pipe 2 and induction pipe 3 are connected by exhaust gas return tube 6, which contains diaphragm-operated exhaust gas return valve 7. A vacuum is supplied to exhaust gas return valve 7 by vacuum control tube 8 which is connected to an induction pipe 3. The entry 9 of vacuum control tube 8 into induction pipe 3 (or butterfly stub pipe 3*a*) is located directly upstream of throttle butterfly 4 when it is in the closed position and, thus, is exposed to ambient air pressure. Under these conditions, practically no exhaust gases are returned via exhaust gas return tube 6 into induction pipe 3.

In vacuum control tube 8, there is a check or non-return valve 10, which is easily opened when subjected to a vacuum on the induction pipe side (as viewed in FIG. 1). Also located in vacuum control tube 8 is thermostatic valve 11 between non-return valve 10 and entry 9. Below a cooling water temperature of, for example 40° C., the vacuum supplied to exhaust gas return valve 7 by vacuum control tube 8 is interrupted by thermostatic valve 11. Hence, exhaust gas return under these conditions does not take place.

Non-return valve 10 includes mushroom-shaped element 10*a* which is formed from an elastic material. Non-return valve 10 is by-passed by by-pass 12 which includes diaphragm-operated by-pass valve 13. By-pass valve 13 is connected to induction pipe 3 (or butterfly stub pipe 3*a*) by pressure tube 14. The entry 15 of pressure tube 14 into induction pipe 3 is located directly downstream of throttle butterfly 4 when it is in the closed position and on that side of induction pipe 3 with respect to which throttle butterfly 4 moves downstream when opening. When throttle butterfly 4 is closed, the entry 15 is located on the vacuum side. Thus, by-pass valve 13 is opened and, via by-pass tubes 12*a* and 12*b*, diaphragm chamber 7*b* of exhaust gas return valve 7 is vented. Diaphragm chamber 7*b* is formed by a spring-loaded diaphragm attached to valve body 7*a*. When diaphragm chamber 7*b* is vented, exhaust gas return valve 7 is closed.

Figure 2:
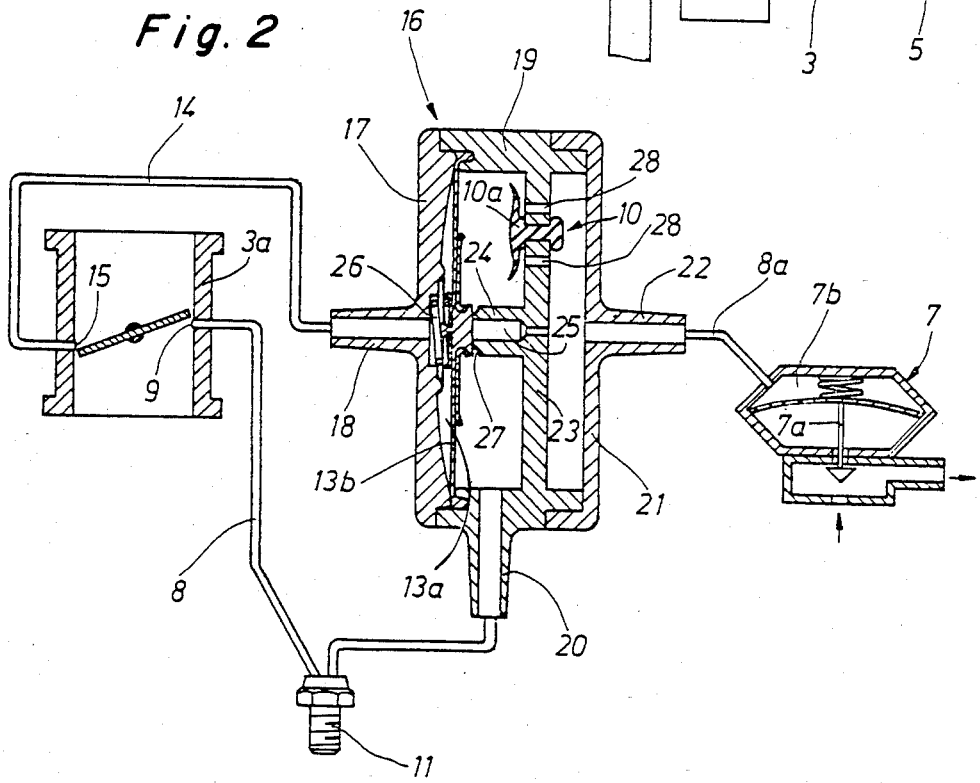
FIG. 2 shows, in section, individual parts combined in one control valve housing and the position of each of the by-pass and non-return valves for a slightly opened throttle butterfly in the induction pipe.

Referring now to FIG. 2, when throttle butterfly 4 is opened, it passes over entry 9 of vacuum control tube 8, so that entry 9 is exposed to the induction pipe vacuum. This vacuum can now fully open exhaust gas return valve 7 via non-return valve 10, which is also opened by the vacuum. Since entry 15 of pressure tube 14 is simultaneously exposed to the ambient air pressure on the atmospheric side of throttle butterfly 4, diaphragm space 13*a* of by-pass valve 13 is ventilated. Thus, the spring loaded diaphragm of by-pass valve 13 moves to close by-pass tube 12*a*. Accordingly, the by-pass around the non-return valve 10 is blocked. Non-return valve 10 maintains, during periods of decreasing induction pipe vacuum, a relatively high vacuum in section 8*a* of vacuum control tube 8. Section 8*a* is connected to exhaust gas return valve 7. Exhaust gas return valve 7 thus remains open until throttle valve 4 returns to the closed or idle position and diaphragm chamber 7*b* of exhaust gas return valve 7 is vented and closed, interrupting the exhaust gas return.

The embodiment shown in FIG. 2 differs from that shown in FIG. 1 in that by-pass valve 13 and non-return valve 10 are combined in a three part control valve housing 16, and diaphragm 13*b* of by-pass valve 13 responds to the differential pressure provided by the pressures in vacuum control tube 8 and pressure tube 14 which depend on the position of throttle butterfly 4.

The control valve housing 16 comprises housing upper part 17 provided with a centrally located pressure connection 18 for pressure tube 14, housing central part 19 provided with a side pressure connection 20 for vacuum control tube 8, and housing lower part 21 provided with a centrally located pressure connection 22 for section 8*a* of vacuum control tube 8. Section 8*a* leads to exhaust gas return valve 7.

Housing central part 19 is provided with intermediate wall 23, which has a protrusion 24 provided with a duct 25 forming the by-pass. Duct 25 is located coaxially with pressure connection 22. Duct 25 is closed by diaphragm 13*b* of by-pass valve 13. Diaphragm 13*b* is clamped between housing upper part 17 and housing central part 19. With a slightly open throttle butterfly 4 (FIG. 2), membrane space 13*a* of by-pass valve 13 is ventilated via pressure tube 14 and diaphragm 13*b* is pressed onto valve seat 27, formed on protrusion 24, by means of a compression spring 26 supported on housing upper part 17.

Intermediate wall 23 is also provided with eccentrically located non-return valve 10, which is also designed as an elastic mushroom-shaped element valve, whose mushroom-shaped element 10*a* controls two passageway holes 28 in intermediate wall 23. The central axes of passagewa holes 28 are generally parallel to the axis of duct 25. When throttle butterfly 4 is positioned as shown in FIG. 2 the induction pipe vacuum opens exhaust gas return valve 7 via non-return valve 10. Non-return valve 10 can close rapidly with decreasing induction pipe vacuum resulting from a wider opening of throttle butterfly 4, as shown in FIG. 3 (i.e., it can trap or lock the high vacuum present in exhaust gas return valve 7 and hold the latter in the open position).

As was previously described in the discussion of the embodiment shown in FIG. 1, by-pass valve 13 (formed by duct 25, diaphragm 13*b* and chamber 13*a* in the unitary housing structure of FIG. 2) opens during idling and thermal override operation when throttle butterfly 4 is closed as shown in FIG. 4. Diaphragm 13*b*, lifted from valve seat 27, permits the supply of fresh air to duct 25, venting diaphragm chamber 7*b* of exhaust gas return valve 7 causing the exhaust gas return to be interrupted.

Figure 5:
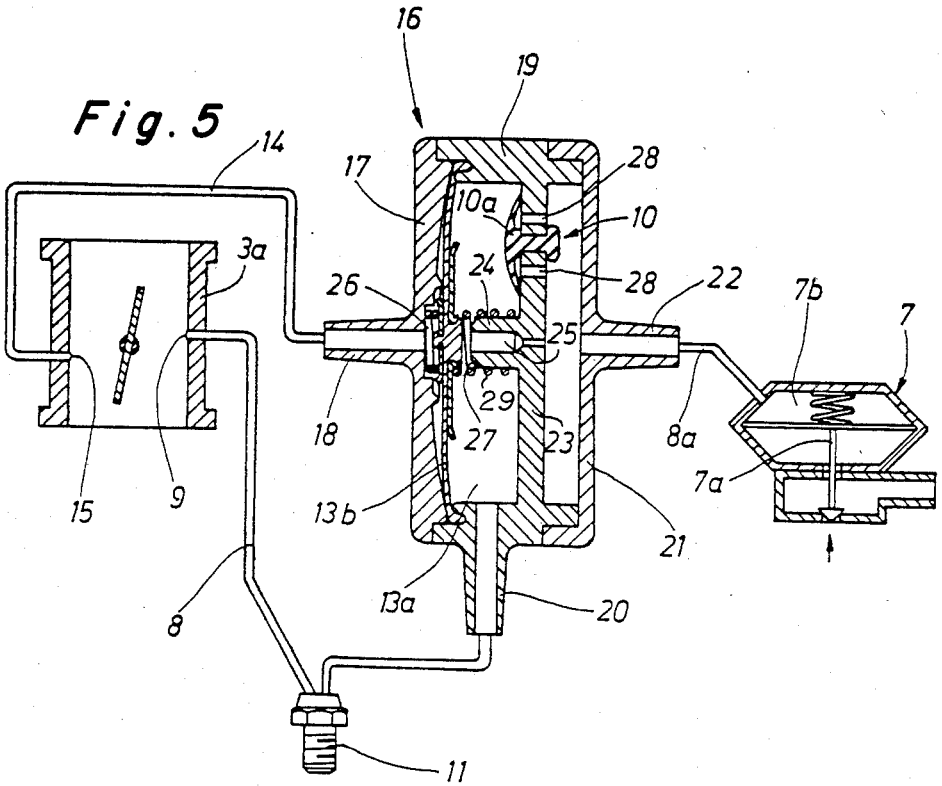
FIG. 5 shows the position of each of the by-pass and non-return valves with a fully open throttle butterfly and the addition of a helical compression spring acting on the diaphragm of the by-pass valve.

As an extension of the embodiment shown in FIG. 2, there is shown in FIG. 5 a helical shaped compression spring 29 positioned on the side of diaphragm 13*b* which faces intermediate wall 23. The strength of compression spring 29 is selected such that for a vacuum value corresponding to the full load operating condition of the engine, compression spring 29 lifts diaphragm 13*b* from the valve seat 27 and thus interrupts the exhaust gas return.

Figure 6:
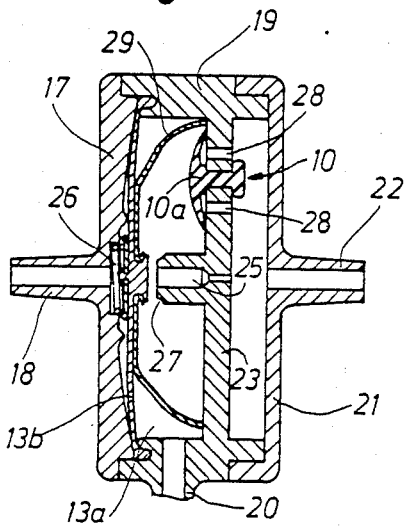
FIG. 6 shows the control valve housing with the compression spring designed as a plate spring.

By means of compression spring 29, the exhaust gas return is not only interrupted during idling and thermal override operation, but it is also interrupted depending on the load condition of the engine, as indicated by the induction pipe vacuum. This occurs regardless of throttle butterfly position and engine rotational speed. The helical shaped compression spring 29 as shown in FIG. 5 can be replaced by a plate spring, as shown in FIG. 6.

In addition to interrupting the exhaust gas return in response to a full load operating conditions, it is possible to interrupt it as a function of time by providing a by-pass throttle formed by a passageway hole 30 in intermediate wall 23, as shown in FIG. 4*a*. By this means, the exhaust gas return is maintained only as long as is desirable.

If desired, the valve arrangements shown in FIGS. 1 to 6 can be utilized wherever vacuum is used to control a device, and would result from retaining and then reducing in a specified manner, the vacuum applied. Thus, applications are not solely restricted to exhaust gas return systems.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. A method of controlling a vacuum-operated control device for an internal combusion engine comprising the steps of:

applying a vacuum to a control device, said vacuum being generated by said engine operating in a first operating condition;

retaining said vacuum throughout a range of engine operating conditions with vacuum retaining means; and relieving said vacuum when said engine operates in a no-load idling condition by activating by-pass means for by-passing said vacuum retaining means, said by-pass means including by-pass valve means connected to an engine induction pipe by a pressure tube, said pressure tube being connected to said induction pipe at a point which is downstream of throttle butterfly means in said induction pipe.

2. Control apparatus for an internal combustion engine, comprising:

an exhaust pipe;

an induction pipe for channeling a flow of air to the engine;

regulating means located in said induction pipe for regulating said flow of air;

exhaust gas return means for channeling a flow of exhaust gas from said exhaust pipe to said induction pipe in response to a vacuum generated by the engine;

means for communicating said vacuum to said exhaust gas return means; and vacuum retaining means for retaining said vacuum supplied to said exhaust gas return means throughout a range of engine operating conditions; and by-pass means for by-passing said vacuum retaining means, said by-pass means capable of connecting points upstream and downstream of said vacuum retaining means when the engine is operating in a no-load idling condition, said by-pass means including by-pass valve means connected to said induction pipe by a pressure tube, said pressure tube being connected to said induction pipe at a point which is downstream of said regulating means.

3. Control apparatus for an internal combustion engine, comprising:

an exhaust pipe;

an induction pipe for channeling a flow of air to the engine;

a regulating means located in said induction pipe for regulating said flow of air to the engine;

diaphragm-operated exhaust gas return means for channeling a flow of exhaust gas from said exhaust pipe to said induction pipe in response to a vacuum generated by the engine;

a vacuum control tube connected to a diaphragm chamber of said exhaust gas return means and connected to said induction pipe at a point which is upstream of said regulating means when said regulating means is in a closed position and which is downstream of said regulating means when said regulating means is in an open position;

Valve means located in said vacuum control tube for retaining said vacuum supplied to said exhaust gas return means throughout a range of engine operating conditions said valve means including a non-return valve which closes when said vacuum in said diaphragm chamber is greater than a vacuum in said induction pipe; and by-pass means for by-passing said valve means, said by-pass means including a diaphragm-operated by-pass valve having a diaphragm chamber connected to said induction pipe by a pressure tube, said pressure tube being connected to said induction pipe at a point which is downstream of said regulating means when said regulating means is in said closed position and which is upstream of said regulating means when said regulating means is in an open position.

4. Control apparatus for an internal combustion engine, comprising:

an exhaust pipe;

an induction pipe for channeling a flow of air to the engine;

throttle butterfly means located in said induction pipe for regulating said flow of air;

exhaust gas return means for channeling a flow of exhaust gas from said exhaust pipe to said induction pipe in response to a vacuum generated by the engine;

means for communicating said vacuum to said exhaust gas return means;

vacuum retaining means for retaining said vacuum supplied to said exhaust gas return means throughout a range of engine operating conditions; and by-pass means for by-passing said vacuum retaining means, said by-pass means being capable of connecting points upstream and downstream of said vacuum retaining means when the engine is operating in a no-load idling condition, said by-pass means including by-pass valve means connected to said induction pipe by a pressure tube, said pressure tube being connected to said induction pipe at a point which is downstream of said throttle butterfly means.

5. Control apparatus according to claim 4, wherein said range of engine operating conditions includes a full load condition.

6. Control apparatus for an internal combustion engine, comprising:

an exhaust pipe;

an induction pipe for channeling a flow of air to the engine;

a throttle butterfly located in said induction pipe for regulating said flow of air to the engine;

diaphragm-operated exhaust gas return means for channeling a flow of exhaust gas from said exhaust pipe to said induction pipe in response to a vacuum generated by the engine;

a vacuum control tube connected to a diaphragm chamber of said exhaust gas return means and connected to said induction pipe at a point which is upstream of said throttle butterfly when said throttle butterfly is in a closed position and which is downstream of said throttle butterfly when said throttle butterfly is in an open position;

Valve means located in said vacuum control tube for retaining said vacuum supplied to said exhaust gas return means throughout a range of engine operating conditions said valve means including a non-return valve which closes when said vacuum in said diaphragm chamber is greater than a vacuum in said induction pipe; and by-pass means for by-passing said valve means, said by-pass means including a diaphragm-operated by-pass valve having a diaphragm chamber connected to said induction pipe by a pressure tube, said pressure tube being connected to said induction pipe at a point which is downstream of said throttle butterfly when said throttle butterfly is in said closed position and which is upstream of said throttle butterfly when said throttle butterfly is in an open position.

7. Control apparatus according to claim 6, further comprising a thermostatic valve located in said vacuum control tube, said thermostatic valve acting to close said vacuum control tube in response to an engine water cooling temperature of less than approximately 40° C.

8. Control apparatus according to claim 6, wherein said range of engine operating conditions includes a full load condition.

9. Control apparatus according to claim 6, wherein said non-return valve includes a mushroom-shaped member formed from an elastic material, said mushroom-shaped member acting to open and close at least one passageway hole.

10. Control apparatus according to claim 6, wherein said by-pass means includes first and second by-pass tubes and wherein said first by-pass tube can be closed by a diaphragm of said diaphragm operated by-pass valve.

11. Control apparatus according to claim 6, wherein said non-return valve and said by-pass valve are combined in a single control valve housing.

12. Control apparatus according to claim 11, wherein said control valve housing comprises an upper part connected to said pressure tube, a central part connected to a first section of said vacuum control tube which is connected to said induction pipe, and a lower part connected to a second section of said vacuum control tube which is connected to said exhaust gas return means.

13. Control apparatus according to claim 12, wherein said central part includes a non-return valve mounted in an intermediate wall.

14. Control apparatus according to claim 13, wherein said intermediate wall includes a passageway hole for relieving said vacuum supplied to said exhaust gas return means.

15. Control apparatus according to claim 13, wherein said intermediate wall includes a centrally located protrusion and wherein said diaphragm operated by-pass valve includes a duct formed in said protrusion and a valve seat formed on said protrusion.

16. Control apparatus according to claim 15, wherein said diaphragm chamber is formed by said upper part of said housing and a diaphragm, said diaphragm being clamped between said upper and said central parts of said housing.

17. Control apparatus according to claim 16, wherein said diaphragm is urged by a first compression spring toward said valve seat.

18. Control apparatus according to claim 17, wherein said diaphragm is urged by a second compression spring, located between said diaphragm and said intermediate wall, away from said valve seat, and wherein said second compression spring lifts said diaphragm off said valve seat when the engine is operating in at least a full load condition.

19. Control apparatus according to claim 18, wherein said second compression spring is a helical spring mounted on said centrally located protrusion.

20. Control apparatus according to claim 18, wherein said second compression spring is a plate spring.

* * * * *

UNITED STATES PATENT AND TRADEMARK OFFICE

CERTIFICATE OF CORRECTION

PATENT NO. : 4,563,998

DATED : January 14, 1986

INVENTOR(S) : Weining et al.

It is certified that error appears in the above-identified patent and that said Letters Patent is hereby corrected as shown below:

Column 1, line 42, change "value" to --valve--.

Column 3, line 14, delete "an".

Column 4, line 35, change "passagewa" to --passageway--.

Column 5, line 4, delete "conditions" and insert --condition--.

Claim 1, line 24, delete "combusion" and insert --combustion--.

Signed and Sealed this

*Twenty-ninth* Day of *July 1986*

[SEAL]

*Attest:*

DONALD J. QUIGG

*Attesting Officer*

*Commissioner of Patents and Trademarks*